US008448591B2

(12) United States Patent
Andersson

(10) Patent No.: US 8,448,591 B2
(45) Date of Patent: May 28, 2013

(54) METHOD AND ARRANGEMENT FOR ATTACHMENT AND/OR DISASSEMBLY/ASSEMBLY OF A TUNNEL THRUSTER

(75) Inventor: Lars-Goran Andersson, Kristinehamn (SE)

(73) Assignee: Rolls-Royce Aktiebolag (SE)

( * ) Notice: Subject to any disclaimer, the term of this patent is extended or adjusted under 35 U.S.C. 154(b) by 20 days.

(21) Appl. No.: 12/935,606

(22) PCT Filed: Apr. 2, 2009

(86) PCT No.: PCT/SE2009/050347

§ 371 (c)(1),
(2), (4) Date: Nov. 4, 2010

(87) PCT Pub. No.: WO2009/126097

PCT Pub. Date: Oct. 15, 2009

(65) Prior Publication Data

US 2011/0036283 A1 Feb. 17, 2011

(30) Foreign Application Priority Data

Apr. 3, 2008 (SE) ..... 0800752

(51) Int. Cl.
*B63H 25/46* (2006.01)

(52) U.S. Cl.
USPC ..... 114/151

(58) Field of Classification Search
USPC ..... 114/148–151
See application file for complete search history.

(56) References Cited

U.S. PATENT DOCUMENTS

| | | | | |
|---|---|---|---|---|
| 3,002,468 | A | 10/1961 | Jardmo | 114/148 |
| 3,513,997 | A * | 5/1970 | Heyer et al. | 414/541 |
| 4,036,163 | A | 7/1977 | Pehrsson | 115/34 |
| 4,696,650 | A | 9/1987 | Haglund | 440/49 |
| 4,884,985 | A * | 12/1989 | Dyrkorn | 440/52 |
| 7,765,946 | B1 * | 8/2010 | Berman et al. | 114/151 |

FOREIGN PATENT DOCUMENTS

| | | |
|---|---|---|
| EP | 0115045 | 8/1984 |
| GB | 1309753 | 3/1973 |
| WO | WO 2005/087584 | 9/2005 |
| WO | WO 2005/100151 | 10/2005 |

OTHER PUBLICATIONS

International Search Report and Written Opinion for Application No. PCT/SE2009/050347 mailed Aug. 24, 2009.

* cited by examiner

*Primary Examiner* — Stephen Avila
(74) *Attorney, Agent, or Firm* — Eric L. Sophir; Dentons US LLP

(57) ABSTRACT

A method and an assembly/disassembly arrangement for a tunnel thruster unit includes a thruster unit and a tunnel, a first attachment arrangement for fitting of said thruster unit to the tunnel and at least one further attachment arrangement for safe fitting of the thruster unit in the tunnel. A further attachment arrangement is in the form of a first interface device fixedly attached to and protruding from attached to the inside of the tunnel wall and a second interface device fixedly attached to the thruster unit.

19 Claims, 4 Drawing Sheets

METHOD AND ARRANGEMENT FOR ATTACHMENT AND/OR DISASSEMBLY/ASSEMBLY OF A TUNNEL THRUSTER

TECHNICAL FIELD

The present invention relates to a method and an assembly/disassembly arrangement for a tunnel thruster unit, comprising a thruster unit and a tunnel, a first attachment arrangement for fitting of said thruster unit to said tunnel and at least one further attachment arrangement for safe fitting of said thruster unit in said tunnel, wherein further attachment arrangement is in the form of a first interface device attached to the inside of the tunnel wall and a second interface device fixedly attached to said thruster unit.

PRIOR ART

A tunnel thruster is a propeller unit mounted in a tunnel to achieve a lateral thrust in order to steer a ship or a platform. In order to facilitate, the term "thruster unit" will in the following be used to denote the actual propeller unit for such a tunnel thruster. Some complications exist when disassembling or assembling such a tunnel thruster. One complication is the limited space defined by the tunnel, leading to difficulties in the disassembly/assembly and that the thruster unit is easily damaged during disassembly/assembly due to narrow margins between the propeller ends and the tunnel wall. Yet another difficulty is caused by the drive shaft of the thruster unit having to project beyond its point of attachment in the tunnel, whereby the height of the thruster unit will be considerably much larger than the diameters of the propeller and tunnel. This is because it is desired, in order to achieve a good thruster capacity, to have a tunnel diameter that is as close as possible to the propeller diameter.

Traditionally, essentially according to the principles of U.S. Pat. No. 3,002,486, U.S. Pat. No. 4,036,163 and U.S. Pat. No. 4,696,650, blocks and tackles are used to move the thruster unit during assembly/disassembly. It is realised that in the limited space offered by the tunnel for the mechanician to work in, it may be difficult by such a method to achieve appropriately controlled guiding.

It is realised that the complications mentioned above mean that traditionally it is avoided to perform such operations below the water surface, since underwater assembly constitutes an additional complication, and therefore that such operations are traditionally made in a dry dock, which is very costly, quite often meaning a cost of at least 200,000 Euro per day, excluding downtime costs for the ship.

From WO 2005/100151 there is known a method and arrangement for attachment and disassembly/assembly respectively of a tunnel thruster which solves many of the above mentioned problems. However, despite the fact that this novel solution provides numerous advantages compared to traditional prior art there still remain complications that may lead to time consuming steps and/or extra cost in connection with assembly and/or disassembly respectively.

BRIEF SUMMARY OF THE INVENTION

It is an object of the present invention to eliminate or at least minimize the above mentioned problems, which is achieved by means of an arrangement according to the pending claims and method in connection therewith respectively.

Thanks to the new arrangement and method many advantages are achieved, which among other things means that in a preferred embodiment disassembly/assembly of a tunnel thruster can be made under water in a manner that is cost and time saving and which may provide increased security.

BRIEF DESCRIPTION OF THE DRAWINGS

In the following, the invention will be described in greater detail with reference to the attached figures, in which.

DETAILED DESCRIPTION

Figure 3:
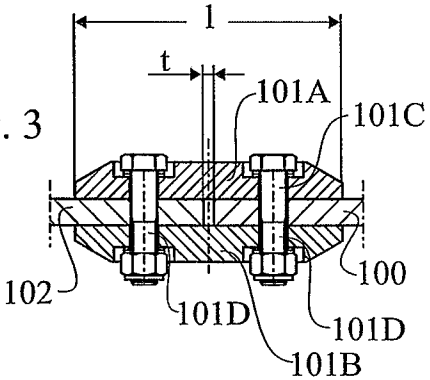
FIG. 3 shows an enlargement of a detail of the arrangement shown in FIG. 1.
Figure 1:
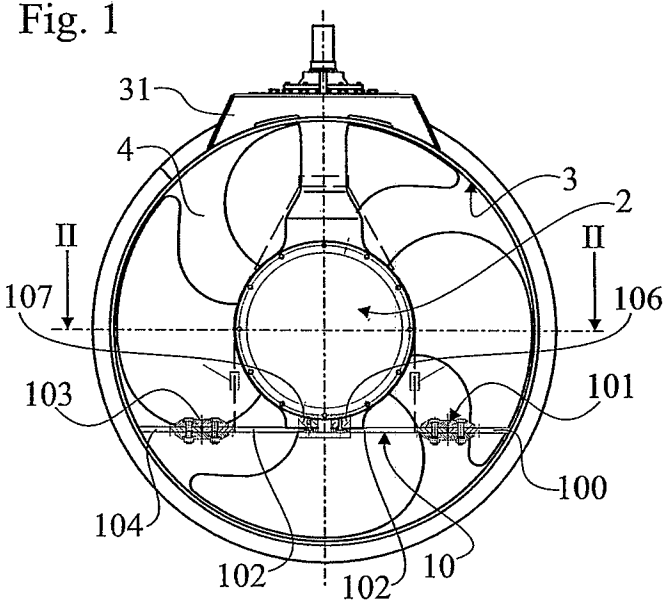
FIG. 1 shows a cross-sectional view through a tunnel having a thruster fitted therein by means of an arrangement according to the invention.

FIG. 1 shows a vertical cross-sectional view transversally through a tunnel 4 having cylindrical inner walls 3 intended for flow of water by means of tunnel thruster unit 2. In a traditional manner the thruster unit 2 is attached with its upper end within a mounting flange 31 in the upper portion of the tunnel 4. Further it is shown that the thruster unit 2 is attached also at a lower portion 106, 107 thereof. A plate 102, is securely attached to a bottom part of the housing of the thruster unit 2, by means of the appropriate fixings, e.g. welds, and/or bolts. This plate 102, extend horizontally in a transverse direction in relation to the longitudinal extension of the tunnel 4. At the same level, and within potentially the same plane, plates 100, 104 are also fixedly attached to the inner wall 3 of the tunnel. As best seen in FIG. 3 the length of the plates 102, and 100, 104 respectively are such that a gap t exists between the opposing edges of the plates, when the thruster unit 2 is in position for attachment. This gap t may be created by means of cutting it, i.e. having the plates 100, 102 and 104, respectively forming an integral plate section prior to cutting them apart whereby the gap t is formed. Indeed this will normally be the case in connection with after installation of an arrangement according to the invention, because in many installations that kind of a supporting plate is used, i.e. bolted to the thruster unit 2 and welded in to the tunnel 3. However, also in connection with new installations one may use the same kind of principle to form a gap t. An advantage of using such a gap t is that it may make it easier to attach the intermediate plate 102 to the unit 2 into position, since the two gaps t on each side will provide a play.

Figure 2:
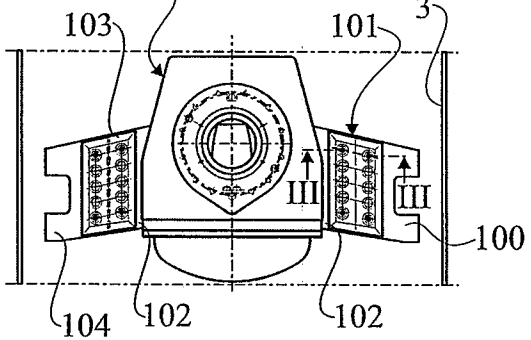
FIG. 2 shows the cross-sectional view indicated by II-II in FIG. 1.

As shown in FIGS. 1-3 clamping means 101, 103 are used to fixedly attach the plates 100, 102, 104, to each other. Each clamping means 101, 103, see FIG. 3, comprises an upper half 101A and a lower half 101B which are clamped together by means of an appropriate numbers of bolts 101D, wherein the extension 1 of the clamping means 101 is large enough to provide a very secure and stable attachment, 103, It follows, that in the plane of the plates the width 1 substantially exceeds the gap t, preferably in the range of 10-50× the width t of the gap. However, it is well understood that there is no actual need for a gap t between the plates 100, 102, 104, by means of the clamping devices 101, 103. Also in the other direction, i.e. parallel with the extension of the tunnel, the clamping devices 101, 103, have a substantial length, indeed preferably larger than the extension in the extension 1 in the transversal direction thereof. A plurality of bolts 101D (see FIG. 2) are positioned in a first row passing through holes in the plate 105, (see FIG. 3, showing an enlargement of one side along III-III in FIG. 2) attached to the unit 2 and a second row of bolts through another row of holes in clamping device 103 and the plates 101 attached to the tunnel 3. Accordingly a very rigid attachment is achieved. Moreover the arrangement of the attachment is such that it is easily fitted also under difficult conditions and being such that once the number of bolts have been tightened the desired positioning of the thruster 2 is achieved.

Figure 4:
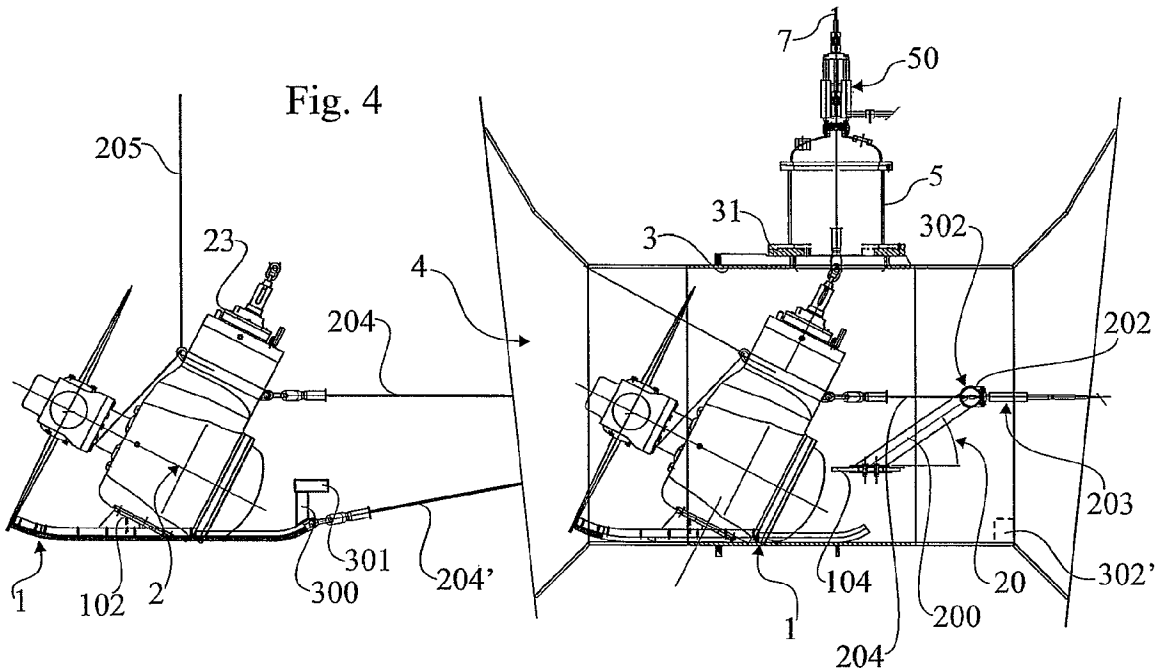
FIG. 4 shows two different sequences during fitting of a tunnel thruster in accordance with the invention, seen in a cross-sectional side view through the tunnel, and having a novel installation arrangement according to the invention fitted therein.

FIG. 4 shows, in a side view, a cross-section of a tunnel 4 inside which a thruster unit 2 is to be mounted. The thruster unit 2 comprises a propeller journalled in a gear mounting/housing, which in turn has a fitting 23 for attachment to a flange 31 inside the tunnel 4, as is known per se. The tunnel 4 is delimited by a cylindrical wall 3 in the side of which said flange 31 is positioned in the middle and at the top.

FIG. 4 shows an initial phase of an assembly of such a thruster unit 2, wherein a watertight mounting hood 5 is (as is known per se) fitted on top of the position of fitting of the axle journal of the thruster unit 2. In the most left hand part of FIG. 4 the thruster unit 2 is shown in a position outside of the tunnel 4, i.e. before it is actually moved into the tunnel. In accordance with what is described in WO 2005/100151 (which is hereby introduced by way of reference) the thruster unit 2 is arranged with an auxiliary transportation device 1, to enable easy and secure movement of the thruster unit 2 within the tunnel 4. Preferably the plate 102 has been removed from the thruster unit 2, prior to mounting of the transportation device (e.g. prior to demounting from the tunnel) to facilitate easier fixing of the transportation device 1. In this position the thruster unit 2 with the auxiliary device 1 is moved into the correct position by means of any suitable, e.g. traditional, lifting equipment (not shown) via a wire 205. In order to be able to easy find the correct position of the unit 2 for introduction into the tunnel 4, the auxiliary device 1 is preferably arranged with a first part of sensor arrangement 300, 301, that is cooperating with matching second part 302 on an installation arrangement 20. This sensor arrangement 301, 302 allows for exact positioning of the thruster unit 2 before movement into the tunnel 4, whereby cumbersome adjustments may be eliminated, which otherwise very often are needed. The sensor arrangement 301, 302 may be of a traditional kind that allows for positioning the thruster unit 2 with the auxiliary device 1 in an desired position. Thereafter the unit 1, 2 may easily be pulled into the tunnel 4 by means of wire 204. As shown in FIG. 4 (left hand side) such a wire 204 may either be attached to the thruster unit 2 or alternatively the wire 204' may be attached to the exterior device 1. A pulling unit 203 attached to the installation arrangement 20 may thereafter easily pull the wire 204 to move the unit 1, 2 into a desired attachment position within the tunnel 4. Once in that position a further wire 7 is attached to the unit 1, 2, which wire 7 by means of a lifting device 50 is used to move the thruster unit 2 in contact with the mounting flange 31, and subsequent fixing thereto.

Figure 5:
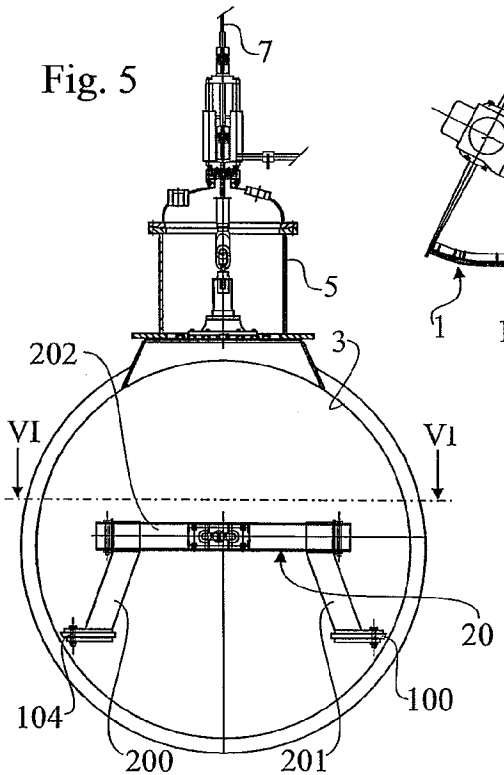
FIG. 5 shows a cross-sectional view seen in line with the axis of the tunnel, having an installation arrangement according to the invention fitted within the tunnel.
Figure 6:
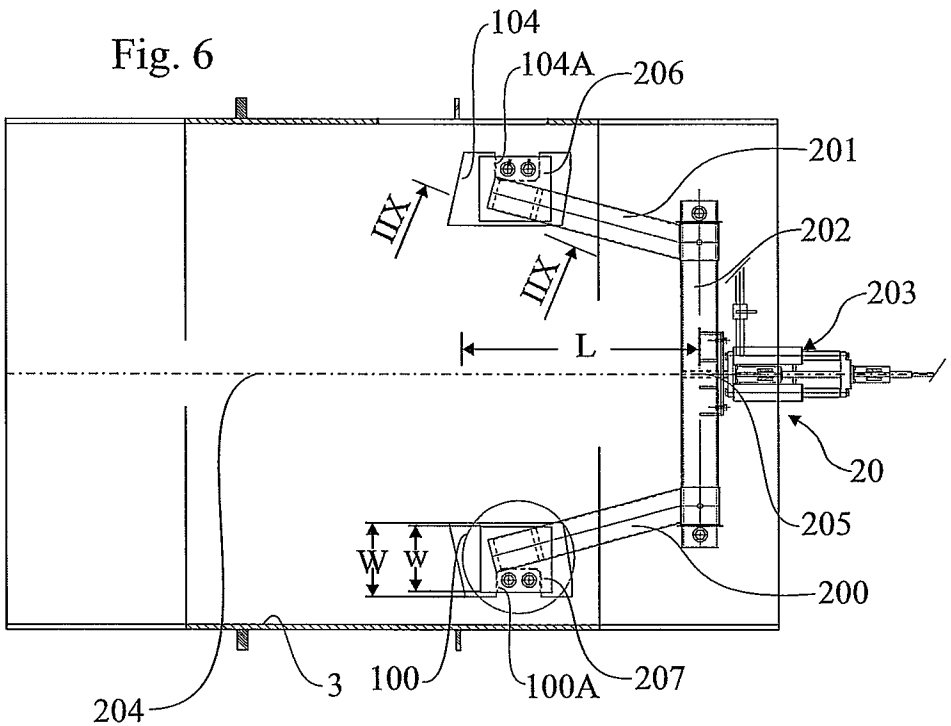
FIG. 6 shows a cross-sectional view of the tunnel seen from above and marked as VI-VI in FIG. 5.

In FIG. 6 there is shown a cross-sectional view from above as indicated in FIG. 5. Both FIGS. 5 and 6 show the installation arrangement 20 as a hole, seen from two different positions. As can be noted the installation arrangement 20 is attached to the fixed mounting plates 100, 104 (also named first interface device), which later are to be fixed to the thruster unit 2, by means of fixing devices 206, 207. Securely (e.g. by welds) attached to said fixing devices 206, 207 there extend arm portions 200, 201, symmetrically in relation to the centre of the tunnel, inclined upwardly an angle $\alpha$ and also inclined slightly inwardly to converge in the direction towards a centre line of the tunnel 4. A crossbar 202 is fixedly attached to the other ends of each arm 200, 201. The crossbar extends transversally in the tunnel having its longitudinal centre substantially coplanar with a horizontal, central plane of the tunnel 4. Substantially coaxial with the centre line of the tunnel 4 there is fixedly attached to the crossbar 202 a pulling device 203. Also, substantially coaxial with the centre line of the tunnel 4 the crossbar 202 is arranged with a through hole 205 for passage of the wire 204 leading into the pulling device 203, which is arranged with a mechanism, that is known per se, that may step-wise pull the wire into the tunnel 4 (see FIG. 9). As is known per se, the pulling device 203 uses two grabbing units 233, 234 working intermittently, to step-wise hold and pull the cable 204 respectively. The rear grabbing device 234 is used to pull the wire 204, by means of moving the outer telescopic part 232 of the pulling device 203 by the use of hydraulic cylinders 230. The functioning of the rear grabbing part 234 is such that as soon as the telescopic part 232 starts moving it will grip onto the wire 204 and pull it together with the movement of the telescopic part 232. Once fully extended, the telescopic part 232 will be reversed, inwardly, whereby the rear grabbing part 234 loses its grip and instead the front holding part 233 will grab on to the wire 204 to not let it move in the direction of the movement of the telescopic part 232. Accordingly a safe and secure movement of the thruster unit 1, 2 may be achieved.

Figure 7:
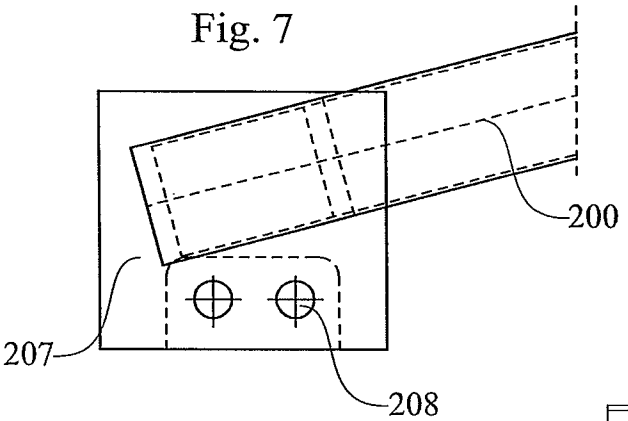
FIG. 7 shows an enlargement of the encircled area presented in FIG. 6.
Figure 8:
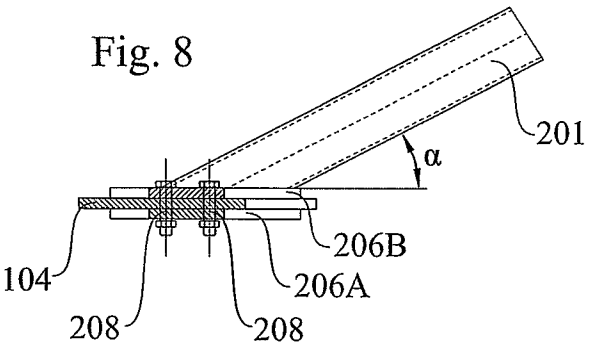
FIG. 8 shows the cross-sectional view presented as IIX-IIX in FIG. 6.

In FIGS. 6, 7 and 8 it is shown in detail that each fixing device 206, 207 comprises a lower plate 206A and an upper plate 206B, that by means of bolts 208 can be securely fixed onto the fixed attachment plates 100, 104. As depicted preferably the attachment plates 100, 104 are arranged with through passages 100A, 104A to allow for flexible positioning/clamping of the fixing devices 206, 207 by means of the bolts 208. Further, it is to be noted that the transversal extension w of the fixing devices 206, 207 is less than the transversal extension W of the attachment plate 100, 104. Thanks to this the fixing devices 206, 207 will not extend into the zone where the gap t is arranged between the thruster unit 2 and the attachment plates 100, 104. Accordingly the installation arrangement 20 is designed such that it does not disturb the movement and/or positioning of the thruster unit 2 into its correct mounting position, partly by not presenting any hindering protruding portions and also by having the crossbar 202 for the pulling device 203 arranged a substantial distance L away from the position of the centre of the thruster unit 2 in its fitted mode.

Figure 10:
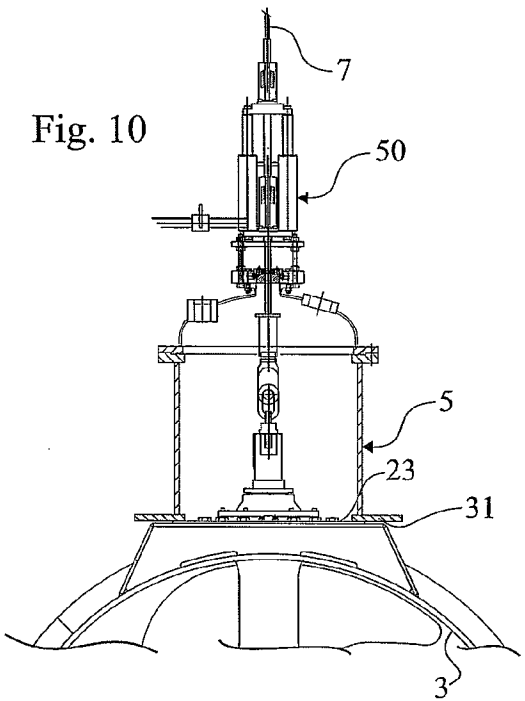
FIG. 10 is a schematic view of a vertical cross-section of the top mounting hood for a tunnel thruster according to the invention.
Figure 9:
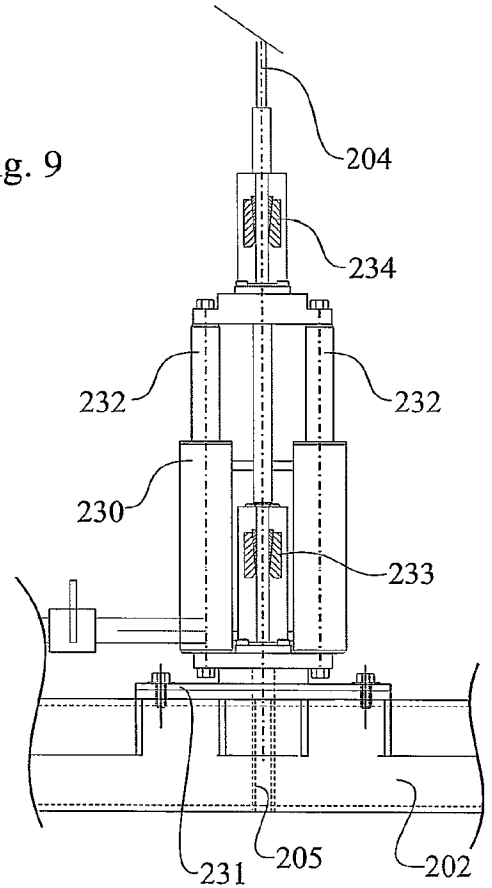
FIG. 9 is an enlargement of a cross-sectional view of a pulling device according to a preferred embodiment of the installation arrangement according to the invention.

In FIG. 10 it is shown in a schematic manner a cross-sectional side view of a hood 5 mounted on top of the attachment flange 31 of the tunnel wall 3 as is known per se, the hood 5 is used to seal the passage up through the tunnel wall 3, to allow for fitting of the thruster unit 2, and its attachment flange 23 without water flowing into the interior of the ship. FIG. 10 further shows that there is a lifting unit 50, to lift the wire 7 attached to the shaft journal of the thruster unit 2. As indicated in this preferred embodiment exactly the same kind of principle, as is shown in FIG. 9, is used for the lifting device 50 as for the pulling device 203, i.e. a hydraulic self grabbing pulling device by means of which an easy lifting is achieved.

Figure 11:
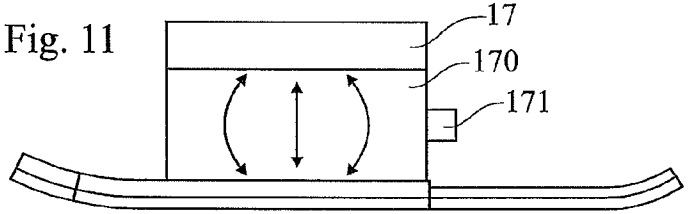
FIG. 11 is a schematic side view of an auxiliary sliding device 1 according to a further embodiment of the invention.

In FIG. 11 there is shown a schematic side view of a sliding device 1 as mentioned above, which has been arranged with a hydraulic subsystem 170, which herein is merely schematically indicated. The hydraulic subsystem 170 comprises a plurality of hydraulic cylinders, preferably water hydraulic, that are used to move and adjustably position the base 17 for attachment to the thruster unit 2. By means of an arrangement as shown in FIG. 11, a plurality of advantages may be achieved in some applications. For instance in connection with fitting of a thruster unit 2 wherein the tunnel 34 is not straight lined, but comprises curved portions, there may exist a need for changing the position of the thruster unit 2 during movement passed said curved portion. Thanks to the adjustable hydraulic subsystem 170 such adjustments may be achieved. Furthermore, the subsystem 170 may indeed in some installations be used instead of a lifting device 50. As mentioned, in the preferred embodiment water hydraulics are used containing a plurality of differently positioned/inclined piston cylinder units controlled by a valve controlling unit 171. Preferably the pressure pump (not shown) for powering the hydraulic unit 170 is positioned on the ship (or a supporting vessel), connected to the hydraulic unit 170 by appropriate flexible tubing. A working pressure of about 8-12 Mpa, maximum water flow of about 5-10 liters/minute and a volume of about 40-80 liter is appropriate, for most applications. The valve controlling unit 171 may in many installations preferably be of a pneumatic kind, but also remotely controlled wire/tubeless control arrangements may be used. Preferably the hydraulic unit 170 provides lateral tilt, cross-directional tilt, raise/lowering, sideways movement and rotation.

The invention is not limited to what has been described above but may be varied within the scope of the claims. It is also realised that even if the assembly as described advantageously can take place underwater, it is obvious that in certain situations the method and the auxiliary device can be used also at dry or semidry conditions. For instance it is evident to the skilled person that other structures than plates may be used to achieve the desired support between the interfaces and the tunnel 3 and thruster unit 2 respectively. Moreover it is evident that a gap t is not necessary, but that for instance, instead of parallelly extending opposing surfaces on each side of the interfaces, V-shaped (seen from above) dividing interface may be used, positioned such that the diverging side thereof opens up in the direction into the tunnel 3 from where the thruster unit 2 will be moved into its position for attachment. Further it is evident that in some embodiments the plate 102 may be left attached to the thruster unit 2, during demounting/transportation/repair, wherein the interface between the transportation device 1 and the thruster unit 2 is appropriately adapted thereto.

The invention claimed is:

1. An assembly/disassembly arrangement for a tunnel thruster unit, comprising a thruster unit and a tunnel, a first attachment arrangement for fitting of said thruster unit to said tunnel and at least one further attachment arrangement for safe fitting of said thruster unit in said tunnel, further comprising having said further attachment arrangement in the form of a first interface device fixedly attached to and horizontally protruding from the inside of the tunnel wall in a traverse direction in relation to a longitudinal extension of the tunnel and a second interface device fixedly attached to said thruster unit.

2. The arrangement according to claim 1, wherein said first and second interface devices are releasably attached to each other by means of a releasable clamping unit.

3. The arrangement according to claim 1, wherein said interface devices extend substantially in a plane that is parallel with an extension of the tunnel.

4. The arrangement according to claim 3, wherein at least one of said interface devices is in the form of a plate.

5. The arrangement according to claim 3, wherein said interface devices present a gap between their opposing end portions.

6. The arrangement according to claim 1, wherein said first interface device is arranged to fit together with a third interface device of an installation arrangement.

7. The arrangement according to claim 6, wherein said third interface, at least in one direction has a width that is smaller than a width of the first interface.

8. The arrangement according to claim 6, wherein said installation arrangement comprises a crossbar carrying a pulling device, whereby arm portions are arranged between said third interface device and said crossbar to securely fix the crossbar a substantial distance away from a transversal vertical plane including said first interface devices.

9. The arrangement according to claim 8, wherein said arm portions are inclined an angle in relation to a centre axis of said tunnel.

10. A method of assembling a thruster unit in a tunnel, comprising the steps of providing a drive connection interface in the tunnel, providing a thruster unit with a corresponding attachment interface, providing a pulling device for pulling the thruster unit into the tunnel for fitting by connecting said interfaces, further comprising: remotely from said drive connection interface providing a first interface device fixedly attached to and protruding from an inside wall of the tunnel providing a second interface device attached to the thruster unit, providing a fixing arrangement to safely interconnect said first and second interfaces; and providing a sliding unit for movement of the thruster unit within the tunnel.

11. The method according to claim 10, further comprising providing said pulling device on a structure having a third interface adapted to fit onto said first interface devices.

12. The method according to claim 10, further comprising providing a hydraulic unit between said sliding unit and said thruster unit and a control unit arranged for adjustment of a position of the thruster unit on the sliding unit.

13. An assembly/disassembly arrangement for a tunnel thruster unit, comprising a thruster unit and a tunnel, a first attachment arrangement for fitting of said thruster unit to said tunnel and at least one further attachment arrangement for safe fitting of said thruster unit in said tunnel, further comprising having said further attachment arrangement in the form of a first interface device fixedly attached to and protruding from the inside of the tunnel wall and a second interface device fixedly attached to said thruster unit, wherein said first interface device is arranged to fit together with a third interface device of an installation arrangement, and wherein said installation arrangement comprises a crossbar carrying a pulling device, whereby arm portions are arranged between said third interface device and said crossbar to securely fix the crossbar a substantial distance away from a transversal vertical plane including said first interface devices.

14. The arrangement according to claim 13, wherein said first and second interface devices are releasably attached to each other by means of a releasable clamping unit.

15. The arrangement according to claim 13, wherein said interface devices extend substantially in a plane that is parallel with an extension of the tunnel.

16. The arrangement according to claim 13, wherein at least one of said interface devices is in the form of a plate.

17. The arrangement according to claim 13, wherein said interface devices present a gap between their opposing end portions.

18. The arrangement according to claim 13, wherein said third interface, at least in one direction has a width that is smaller than a width of the first interface.

19. The arrangement according to claim 13, wherein said arm portions are inclined an angle in relation to a centre axis of said tunnel.

* * * * *